US007845196B1

(12) United States Patent
Pai

(10) Patent No.: US 7,845,196 B1
(45) Date of Patent: Dec. 7, 2010

(54) CIRCULAR KNITTING MACHINE HAVING INTEGRATED MULTIPLE YARN CHANGING APPARATUS

(75) Inventor: Tieh-Hsiung Pai, Taipei Hsien (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 12/755,738

(22) Filed: Apr. 7, 2010

(51) Int. Cl.
*D04B 15/58* (2006.01)

(52) U.S. Cl. ..... 66/133; 66/138

(58) Field of Classification Search ..... 66/133, 66/134, 135, 138, 140, 141
See application file for complete search history.

(56) References Cited

U.S. PATENT DOCUMENTS 4,404,821 A * 9/1983 Johnson et al. ..... 66/139
4,656,842 A * 4/1987 Sawazaki et al. ..... 66/139
5,070,709 A * 12/1991 Guell ..... 66/140 R
5,218,845 A 6/1993 Wang
6,000,245 A * 12/1999 Plath et al. ..... 66/139
6,058,742 A * 5/2000 Dalmau Guell ..... 66/140 R
6,408,655 B1 * 6/2002 Ossensi et al. ..... 66/140 R
6,655,176 B1 12/2003 Wang
7,036,343 B1 5/2006 Wei
7,055,348 B1 6/2006 Wei
7,073,355 B2 7/2006 Traenkle et al.
7,690,224 B1 * 4/2010 Wei ..... 66/140 R

* cited by examiner

*Primary Examiner*—Danny Worrell
(74) *Attorney, Agent, or Firm*—Muncy, Geissler, Olds & Lowe, PLLC

(57) ABSTRACT

A circular knitting machine having an integrated multiple yarn changing apparatus comprises a first yarn changing apparatus, a second yarn changing apparatus, and a driving cam set. The first and second yarn changing apparatus include respectively at least one yarn feeding means which is moved outwards through a first yarn feeding stroke and a second yarn feeding stroke to a yarn feeding position. The driving cam set includes a first driving track and a second driving track to respectively drive the yarn feeding means to proceed the first and second yarn feeding strokes. The second driving track has a driving delay zone to generate a yarn feeding time lag between the first and second yarn feeding strokes. Knitting needles located between the first and second yarn feeding means are guided to a yarn hooking position to respectively hook the yarn due to the yarn feeding time lag.

8 Claims, 18 Drawing Sheets

CIRCULAR KNITTING MACHINE HAVING INTEGRATED MULTIPLE YARN CHANGING APPARATUS

FIELD OF THE INVENTION

The present invention relates to a circular knitting machine equipped with yarn changing apparatus and particularly to a circular knitting machine having integrated multiple yarn changing apparatus.

BACKGROUND OF THE INVENTION

To increase fabric knitting versatility the technique of equipping a circular knitting machine with yarn changing apparatus to add yarns of other colors or types in the knitting fabric is widely adopted in textile industry. Reference of such technique can be found in U.S. Pat. Nos. 7,036,343, 7,055,348, 6,655,176 and 5,218,845.

A yarn changing apparatus 10 is disclosed in U.S. Pat. No. 5,218,845 as shown in FIGS. 1A through 1D. It mainly comprises a yarn feeding plate 11, a yarn clipping plate 12 and a spacer 13. In a yarn non-feeding condition, the yarn feeding plate 11 and yarn clipping plate 12 are retracted in the yarn changing apparatus 10, and the yarn clipping plate 12 has a hook 121 at the front end to clip a yarn 15 between the yarn clipping plate 12 and spacer 13. In a yarn feeding condition, the yarn feeding plate 11 is driven forwards with a front end 111 moved out (referring to FIG. 1B) to pull the yarn 15 outwards to a yarn feeding position so that a knitting needle 14 can hook the yarn to do knitting operation. When the yarn feeding plate 11 is move outwards its tail end 112 hits a first strut 122 of the yarn clipping plate 12 to move the yarn clipping plate 12 in the same direction of the yarn feeding plate 11 until the yarn feeding plate 11 is moved to the yarn feeding position, then the hook 121 of the yarn clipping plate 12 releases the yarn 15 (referring to FIG. 1C).

When change to other yarn is desired, the yarn feeding plate 11 previously moved to the yarn feeding position is retracted into the yarn changing apparatus 10, and a nose 113 of the yarn feeding plate 11 hits a second strut 123 of the yarn clipping plate 12 to move the yarn clipping plate 12 back into the yarn changing apparatus 10 (referring to FIG. 1D). When the retraction is finished, the yarn 15 is severed by scissors and clipped between the hook 121 and spacer 13 again (return to the condition shown in FIG. 1A).

The aforesaid yarn changing apparatus can provide multiple yarn colors or types. Take a commonly adopted one with four colored yarns as an example, each yarn changing apparatus includes four sets of yarn feeding plates and yarn clipping plates arranged in a juxtaposed manner to change four types of yarns.

To increase the number of changeable yarns, more yarn feeding plates and yarn clipping plates are added to the yarn changing apparatus, such as six sets of yarn feeding plates and yarn clipping plates for a six-colored-yarn changing apparatus. However, with increasing number of changeable yarns, more yarn feeding plates and yarn clipping plates have to be added, and the volume of the yarn changing apparatus increases. Therefore, the number of the yarn changing apparatus installable on one circular knitting machine would be reduced. On the other hand, to maintain the original installed number, the size of the yarn changing apparatus has to be maintained, and the composed elements have either to be shrunk or made thinner. This results in a lower mechanical strength and decreased reliability. Moreover, when moving forwards or backwards, the yarn feeding plate needs an additional stroke to drive the yarn clipping plate. With more yarn changing movements taking place on one yarn changing apparatus, knitting speed would be decreased.

In order to maintain the design of the general yarn changing apparatus and also achieve more yarn changing effect to increase knitting diversity of the circular knitting machine, U.S. Pat. No. 7,073,355 discloses a knitting machine with at least one striping attachment which mainly includes a bracket to hold knitting tools, a cam mechanism and a yarn striping means. The cam mechanism has at least one loop forming zone in which the selected knitting tools are moved to a yarn drawing position. The yarn striping means feeds the selected yarn to a knitting tool already at the yarn drawing position. The yarn striping means includes at least a first yarn changing apparatus and a second yarn changing apparatus that are selectively fed with a yarn through an engagement means, then the knitting tool already at the yarn drawing position is deployed in the loop forming zone.

Although U.S. Pat. No. 7,073,355 provides the engagement means to selectively bring the yarn of the first or second yarn changing apparatus into the loop forming zone, the yarn changing apparatus and knitting needles are spaced at a narrow space, and the engagement means has to be installed and operate in that narrow space, installation is difficult. In the yarn non-feeding condition the engagement means becomes a spatial obstacle for knitting. Moreover, the yarn engagement means holds the yarn through a clipping means. Tight or loose condition of the clipping means affects whether the yarn can be carried to the loop forming zone to be knitted by the knitting tool. Too strong of clipping force makes the yarn difficult to leave the engagement means, while inadequate clipping force makes the yarn leaving the engagement means too early. All this hinders yarn changing and affects the quality of knitted fabrics.

SUMMARY OF THE INVENTION

The primary object of the present invention is to provide a circular knitting machine to expand yarn color or type changing number without damaging knitting quality. To achieve the foregoing object the circular knitting machine according to the present invention comprises a first yarn changing apparatus, a second yarn changing apparatus, a driving cam set and at least one needle cylinder holder holding a plurality of knitting needles. The first yarn changing apparatus and second yarn changing apparatus include respectively at least a first yarn feeding means and at least a second yarn feeding means. The first and second yarn feeding means are moved outwards respectively through a first yarn feeding stroke and a second yarn feeding stroke to a yarn feeding position to supply yarns. The driving cam set includes a first driving track and a second driving track to drive respectively the first and second yarn feeding means to proceed the first and second yarn feeding strokes. The second driving track further has a driving delay zone to form a yarn feeding time lag between the second yarn feeding means while proceeding the second yarn feeding stroke and the first yarn feeding means while proceeding the first yarn feeding stroke. The needle cylinder holder includes at least directing and moving a knitting needle between the yarn feeding position of the first and second yarn feeding means to a yarn hooking position to hook yarns supplied by the first and second yarn feeding means during the yarn feeding time lag.

The circular knitting machine of the present invention, through the yarn feeding time lag, allows the yarns supplied by the first and second yarn feeding means to be hooked by the knitting needles at the yarn hooking position thereby provide versatile yarn knitting without adding extra elements between the yarn changing apparatus and knitting needles. Hence there is no spatial obstacle during the yarn feeding process. On the other hand, the yarn feeding means on the yarn changing apparatus of the present invention still directly supplies the yarns to the knitting needles without creating the problem of drawing by other elements to form yarns loosening or hooking failure of the knitting needles.

The foregoing, as well as additional objects, features and advantages of the present invention will be more readily apparent from the following detailed description, which proceeds with reference to the accompanying drawings.

DETAILED DESCRIPTION OF THE PREFERRED EMBODIMENTS

Figure 1A:
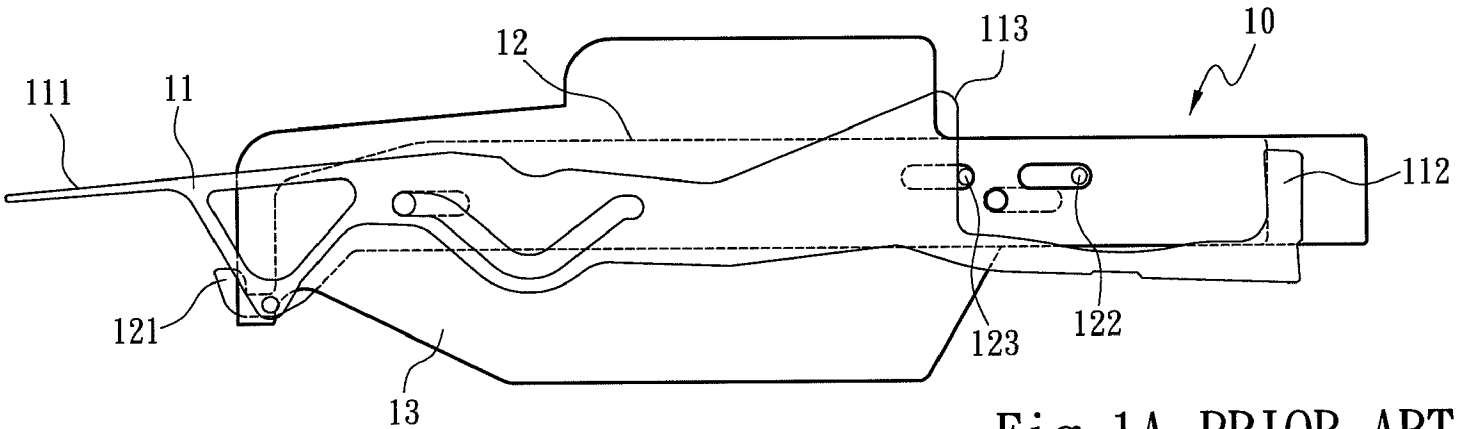
Fig. 1A PRIOR ART
FIGS. 1A through 1D are schematic views of a conventional technique for yarn changing in continuous operating conditions.
Figure 1B:
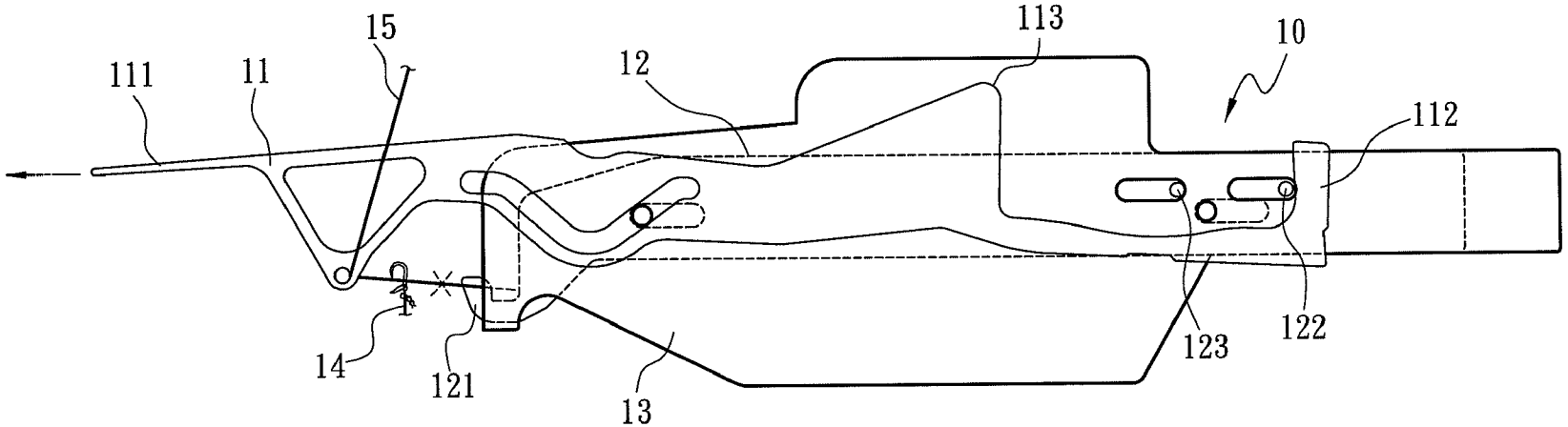
Fig. 1B PRIOR ART
Figure 1C:
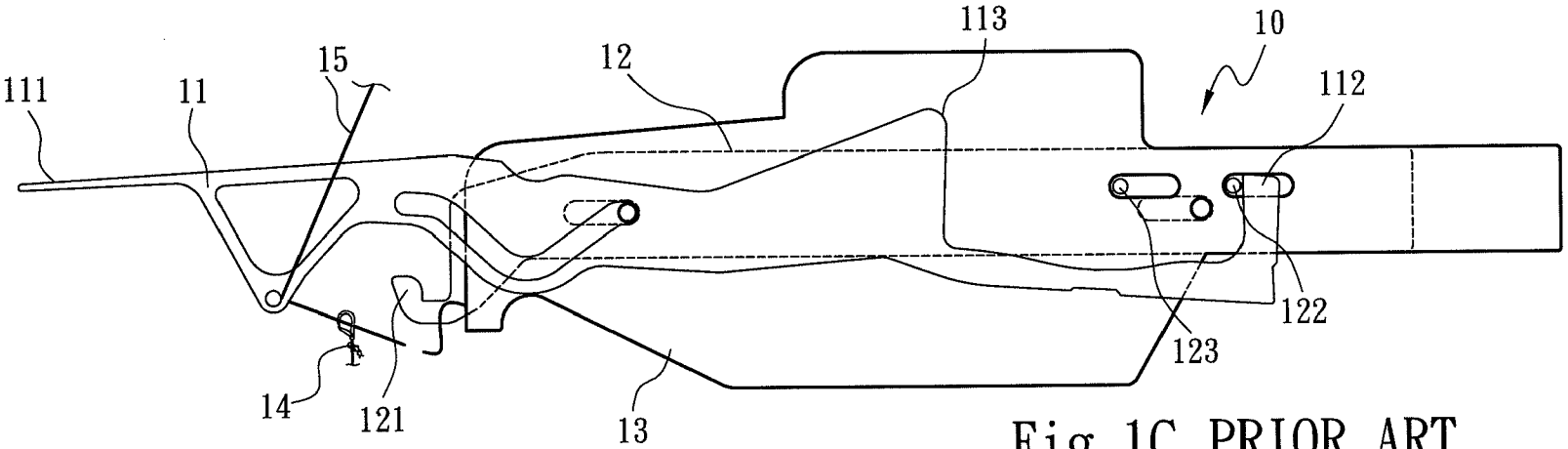
Fig. 1C PRIOR ART
Figure 1D:
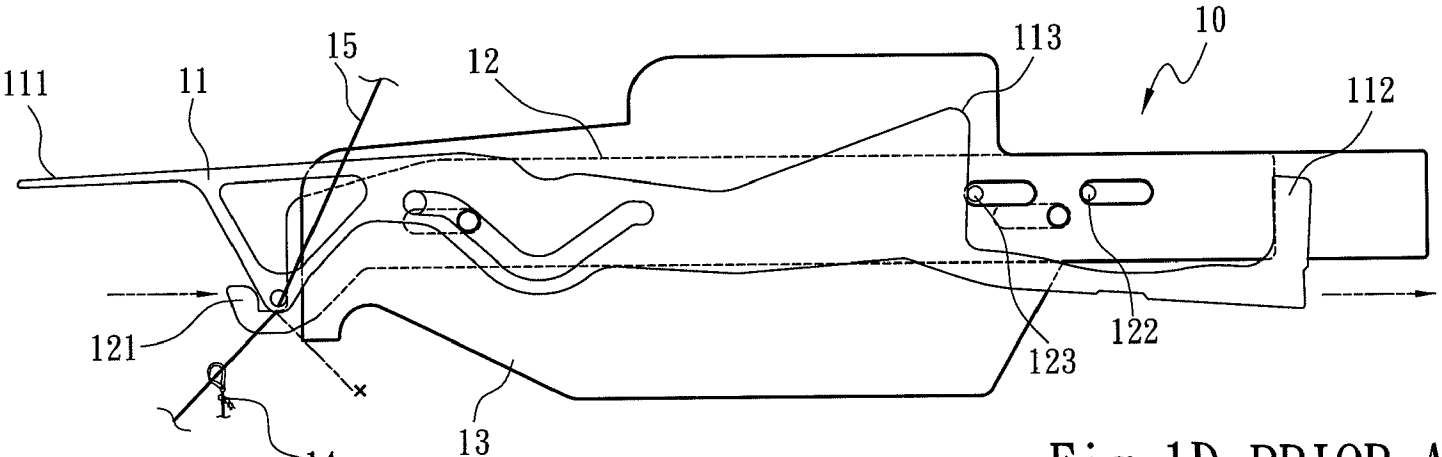
Fig. 1D PRIOR ART
Figure 2:
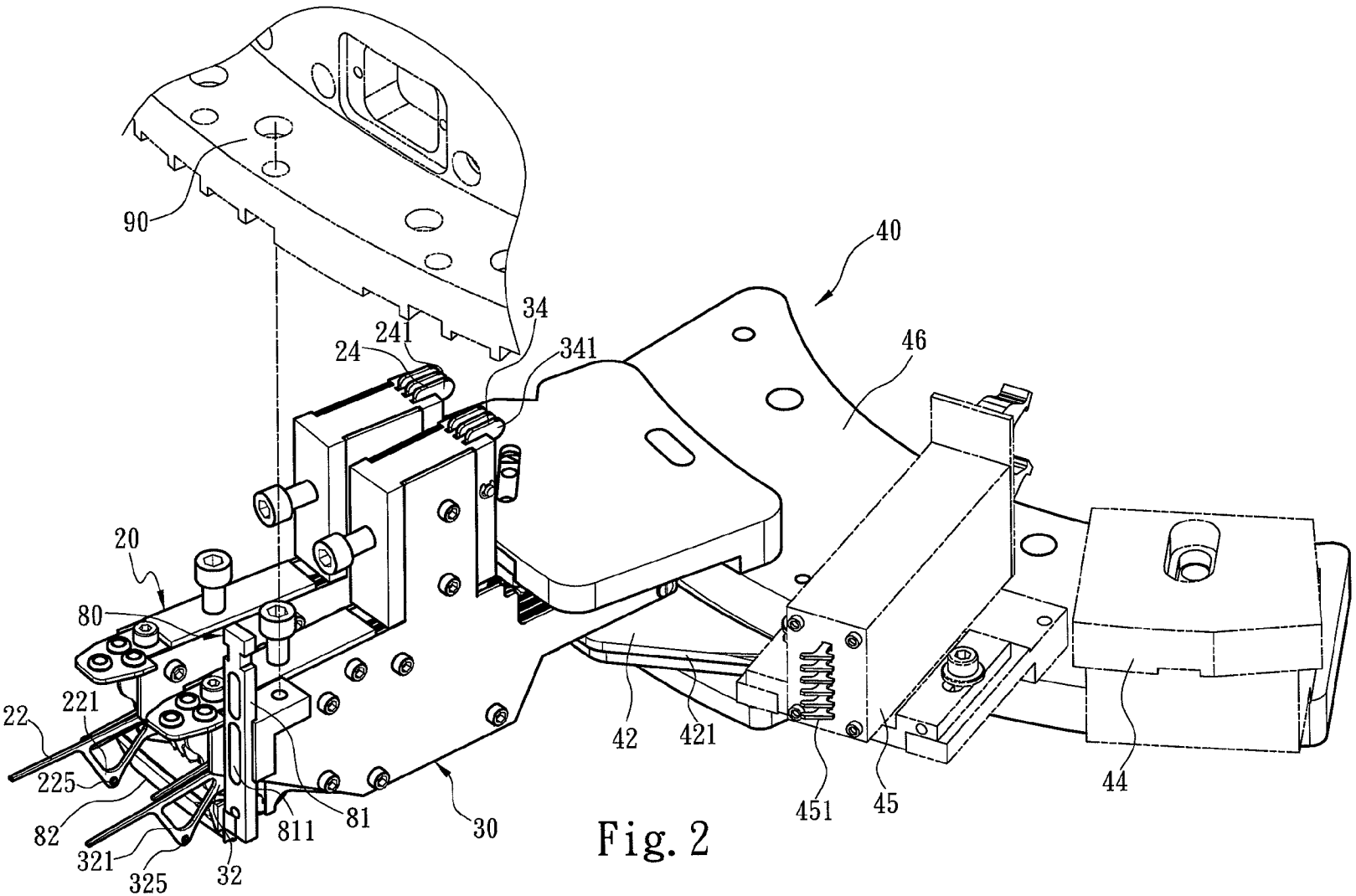
FIG. 2 is a perspective view of an embodiment of the circular knitting machine having integrated multiple yarn changing apparatus according to the present invention.
Figure 3:
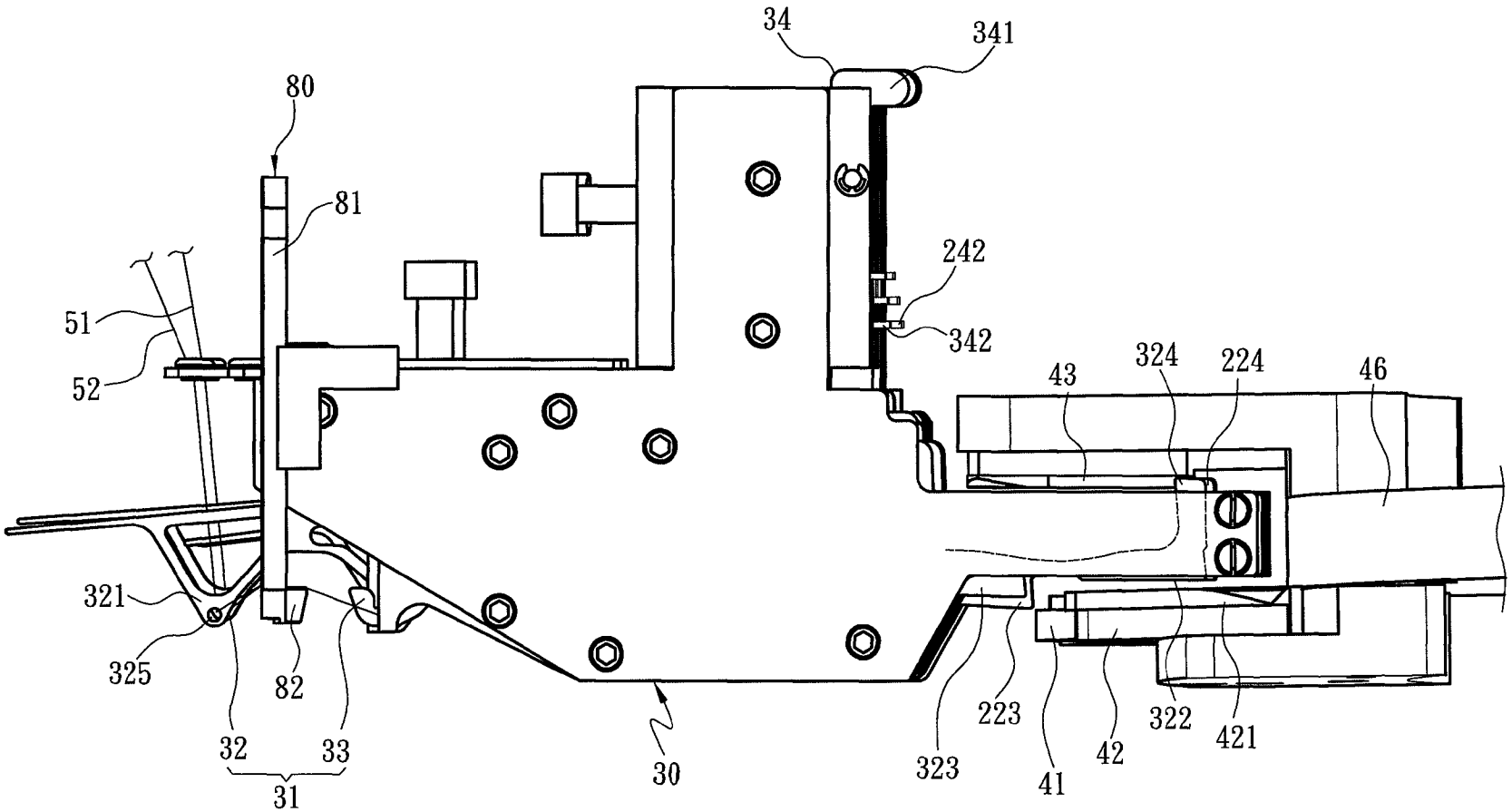
FIG. 3 is a side view of an embodiment of the circular knitting machine having integrated multiple yarn changing apparatus according to the present invention.
Figure 4:
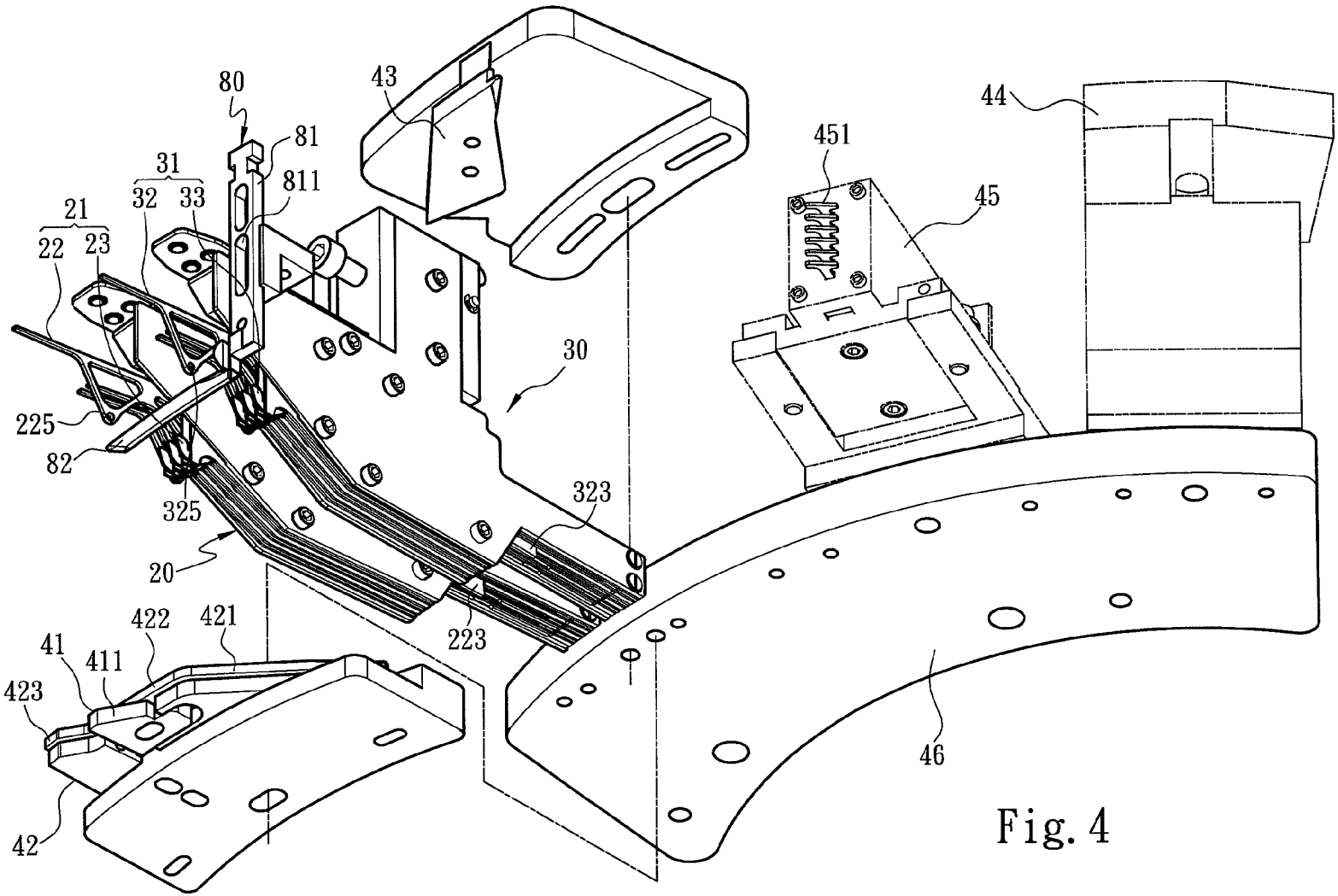
FIG. 4 is an exploded view of an embodiment of the circular knitting machine having integrated multiple yarn changing apparatus according to the present invention.

Please refer to FIGS. 2, 3 and 4 for an embodiment of the present invention. The circular knitting machine according to the present invention includes a plurality of yarn changing sets each has at least a first yarn changing apparatus 20 and a second yarn changing apparatus 30 that are installed on a support deck 90 of the circular knitting machine.

The present invention is adaptable to a wide variety of yarn changing apparatus. The following provides an embodiment which merely serves for illustrative purpose and is not the limitation of the present invention. The first yarn changing apparatus 20 has at least one first yarn feeding means 21. The second yarn changing apparatus 30 has at least one second yarn feeding means 31. In this embodiment the first or second yarn changing apparatus 20 and 30 includes three sets of first or second yarn feeding means 21 and 31. The first yarn feeding means 21 includes a first yarn feeding plate 22 and a first yarn clipping plate 23. The first yarn feeding plate 22 has a head end 221 and a tail end 222 (referring to FIG. 6A). The tail end 222 has a first forward boss 223 and a first backward boss 224. The first forward boss 223 is driven by a force to push the first yarn feeding plate 22 to proceed a first yarn feeding stroke so that the head end 221 is moved towards an outer side of the first yarn changing apparatus 20 to a yarn feeding position and hook a yarn 51 threaded through a yarn feeding eyelet 225 on the head end 221. The first yarn clipping plate 23 and first yarn feeding plate 22 are moved together. The first yarn feeding means 21 further has a first trigger crank 24 which includes a reset boss 241 and a selection boss 242. The reset boss 241 is depressible to move the first trigger crank 24 to an action position in which the first forward boss 223 is exposed outside the first yarn changing apparatus 20. The selection boss 242 also is depressible to move the first trigger crank 24 to a closed position in which the first forward boss 223 is retracted inside the first yarn changing apparatus 20 while the first return boss 224 is exposed outside the first yarn changing apparatus 20.

The second yarn feeding means 31 is substantially constructed like the first yarn feeding means 21 and mainly includes a second yarn feeding plate 32 and a second yarn clipping plate 33. The second yarn feeding plate 32 has a head end 321 and a tail end 322. The tail end 322 has a second forward boss 323 and a second return boss 324. The second forward boss 323 is driven by a force to push the second yarn feeding plate 32 to proceed a second yarn feeding stroke so that the head end 321 is moved towards an outer side of the second yarn changing apparatus 30 to a yarn feeding position and hook another yarn 52 threaded through another yarn feeding eyelet 325 on the head end 321. The second yarn clipping plate 33 and first yarn feeding plate 32 are moved together. The second yarn feeding means 31 further has a first trigger crank 34 which includes a reset boss 341 and a selection boss 342. The reset boss 341 is depressible to move the second trigger crank 34 to an action position in which the second forward boss 323 is exposed outside the second yarn changing apparatus 30. The selection boss 342 also is depressible to move the second trigger crank 34 to a closed position in which the second forward boss 323 is retracted inside the second yarn changing apparatus 30 while the second return boss 324 is exposed outside the second yarn changing apparatus 30. In the first yarn feeding stroke the first forward boss 223 is located at a position lower than of the second forward boss 323 in the second yarn feeding stroke.

The circular knitting machine also includes a driving cam set 40 corresponding to the tail ends 222 and 322 of the first and second yarn feeding plates 22 and 32. The driving cam set 40 includes a first forward cam 41 and a second forward cam 42 engaged with the first forward cam 41. The first forward cam 41 has a first yarn release zone 411. The second forward cam 42 has a guiding zone 421, a driving delay zone 422 and a second yarn release zone 423. The first yarn release zone 411 is overlapped with the driving delay zone 422 such that the first forward cam 41 and the second forward cam 42 form a section difference between them. The guiding zone 421 and the first yarn release zone 411 form a first driving track. The guiding zone 421, driving delay zone 422 and second yarn release zone 423 are coupled to form a second driving track. The first yarn release zone 411 on the first driving track and the driving delay zone 422 and second yarn release zone 423 on the second driving track are located on different horizontal levels. The driving cam set 40 further includes a return cam 43, a reset cam 44 and a selector 45. The driving cam set 40 is located on a holding deck 46 which carries the driving cam set 40 to move circularly along the rear end of the yarn changing sets. The return cam 4 drives the first return boss 224 and second return boss 324. The reset cam 44 corresponds to the reset bosses 241 and 341 on the first and second trigger cranks 24 and 34. When the reset cam 44 is moved to the first and second yarn changing apparatus 20 and 30 it exerts a pressure on all the reset bosses 241 and 341 so that the first and second trigger cranks 24 and 34 are in the action condition. The selector 45 has a plurality of striking pins 451 selectively jutting from the surface of thereof to trigger and press the selection bosses 242 and 342 to move the first and second trigger cranks 24 and 34 to the closed position.

In this invention the first and second yarn feeding means 21 and 31 are moved respectively along the first and second driving tracks to proceed the first and second yarn feeding strokes. Referring to FIG. 2, the first forward boss 223 of the first yarn feeding plate 22 is located at a lower position in the first yarn feeding stroke than the second forward boss 323 of the second yarn feeding plate 32 in the second yarn feeding stroke as previously discussed. The first yarn release zone 411 of the first driving track also is located lower than the driving delay zone 422 and the second yarn release zone 423 of the second driving track. Hence the first forward boss 223 is driven by the guiding zone 421 of the second forward cam 42 and the first yarn release zone 411 of the first forward cam 41, i.e. moves along the first driving track to make the first yarn feeding plate 22 to proceed the first yarn feeding stroke until reaching the yarn feeding position. On the other hand, the second forward boss 323 is driven by the guiding zone 421, driving delay zone 422 and second yarn release zone 423 of the second forward cam 42 along the second driving track to make the second yarn feeding plate 32 to proceed the second yarn feeding stroke until reaching the yarn feeding position.

Figure 5:
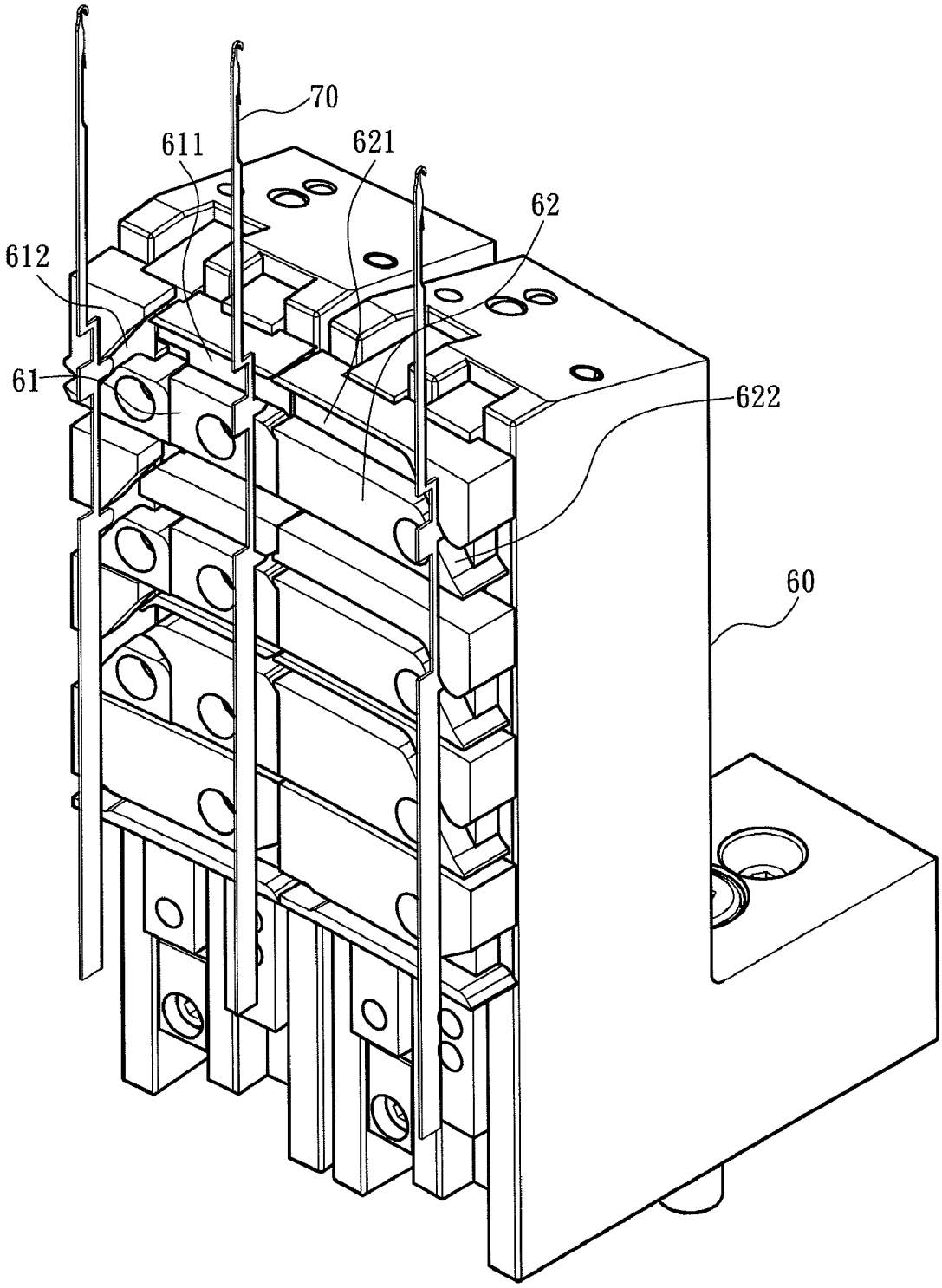
FIG. 5 is a perspective view of an embodiment of the needle cylinder holder of the present invention.

Referring to FIG. 5, the circular knitting machine of the present invention also includes a plurality of knitting needles 70 surrounding the yarn changing sets. The knitting needles 70 are located on at least one needle cylinder holder 60 which has a first cam 61 and a second cam 62 corresponding respectively to the first yarn changing apparatus 20 and second yarn changing apparatus 30 to guide the knitting needles 70 to move between a yarn hooking position and an inactive position. FIG. 5 depicts an embodiment of the needle cylinder holder 60 in which the first cam 61 and second cam 62 have respectively a track to guide the knitting needles 70, and also yarn hooking tracks 611 and 621 to move the knitting needles 70 to the yarn hooking position and standby tracks 612 and 622 to move the knitting needles 70 to the inactive position. The yarn hooking tracks 611 and 621 are positioned at least against where the first yarn feeding means 21 extended to the second yarn feeding means 31, and are linked together to maintain the yarn hooking position for the knitting needles 70 between the first cam 61 and second cam 62. Thus the knitting needles 70 can hook the yarns 51 and 52 provided by the first and second yarn feeding means 21 and 31 at the yarn feeding position.

Referring to FIG. 2, the present invention also provides a yarn supply means 80 which includes a fastening portion 81 and a yarn supply portion 82. The fastening portion 81 has at least one fastening hole 811 to receive a fastening element (such as a screw, a bolt or the like) to fasten the yarn supply means 80 to the support deck 90 of the circular knitting machine. The yarn supply portion 82 is fastened to one end of the fastening portion 81 and extended to at least the knitting needles 70 at the yarn feeding position between the first and second yarn feeding means 21 and 31.

Refer to FIGS. 6A through 6D, and 7A through 7D for the continuous operating conditions of an embodiment of the driving cam set and first and second yarn feeding means.

Figure 6A:
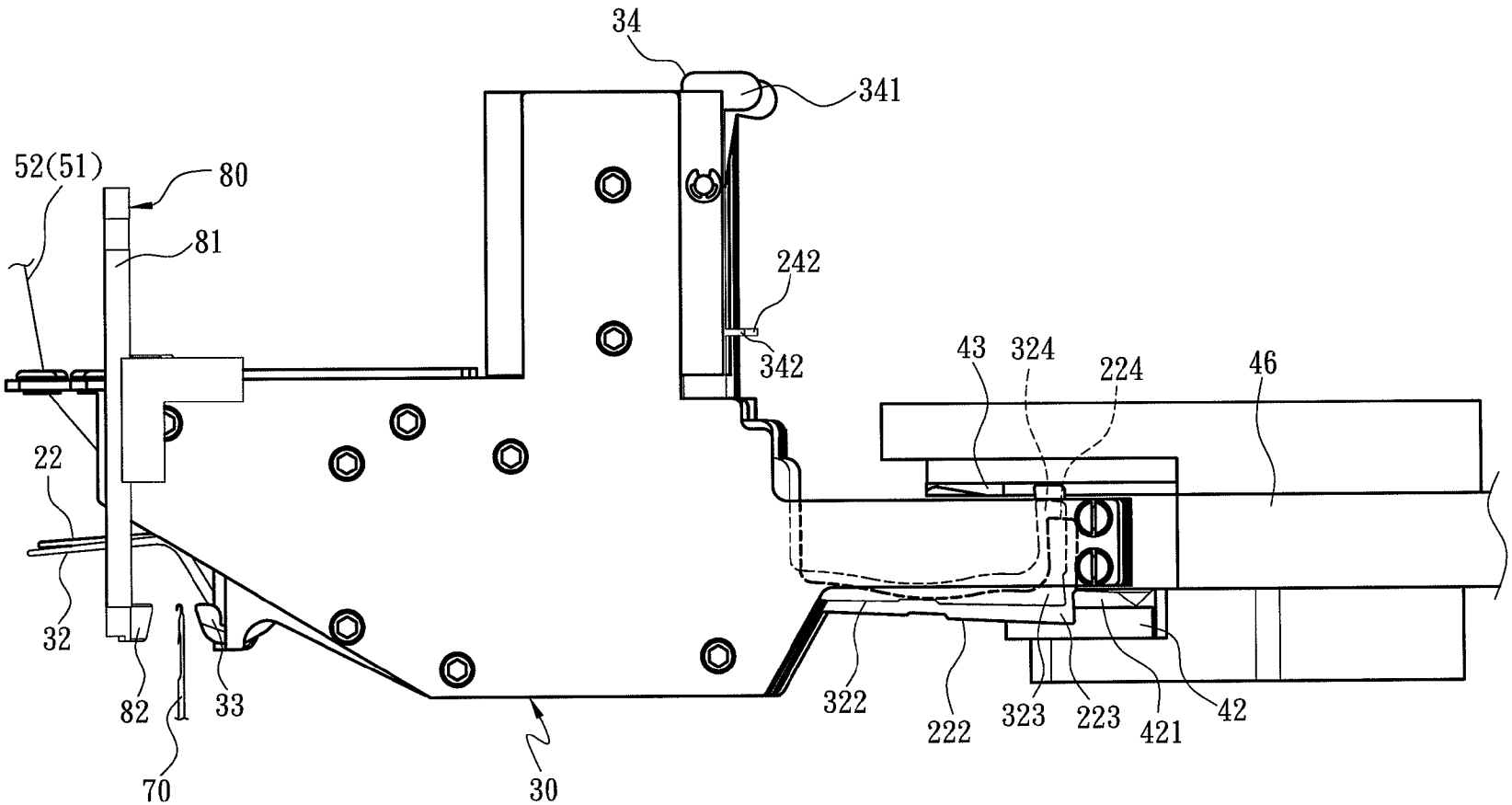
FIGS. 6A through 6D are schematic side views of an embodiment of the present invention showing continuous operating conditions of the driving cam set driving the first and second yarn feeding means to proceed the first and second yarn feeding strokes.
Figure 6B:
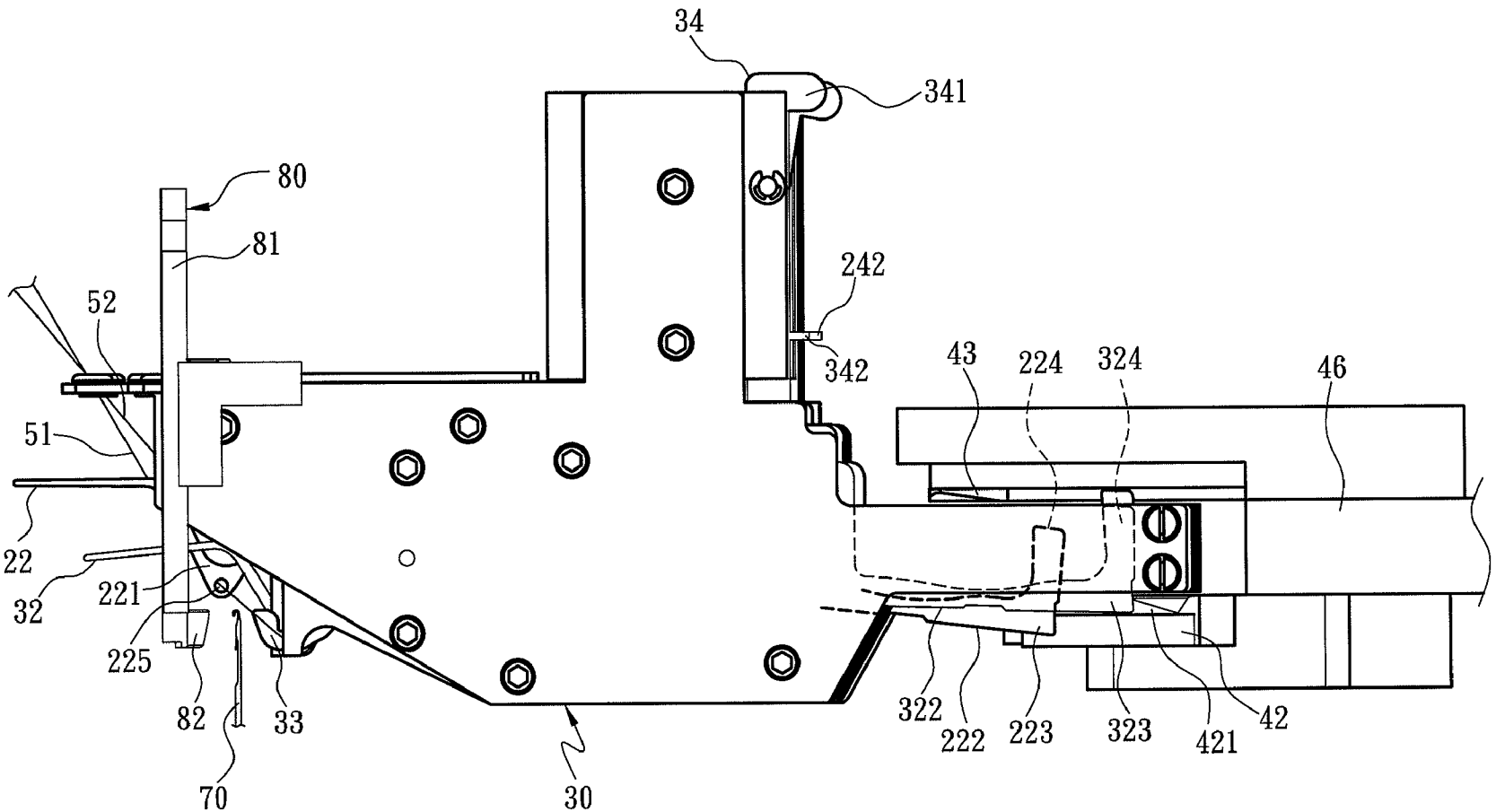
Figure 7A:
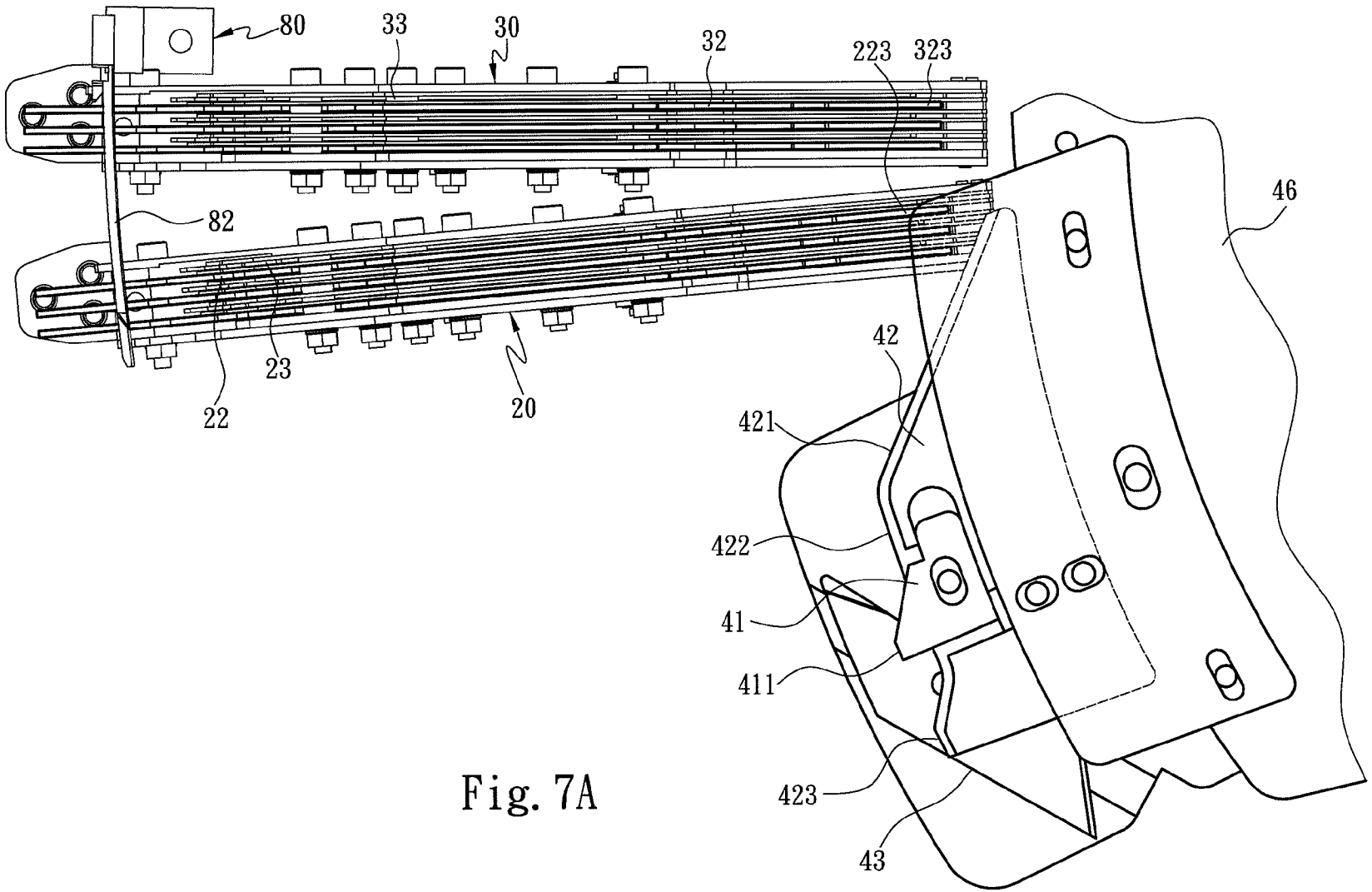
FIGS. 7A through 7D are schematic bottom views of an embodiment of the present invention showing continuous operating conditions of the driving cam set driving the first and second yarn feeding means to proceed the first and second yarn feeding strokes.
Figure 7B:
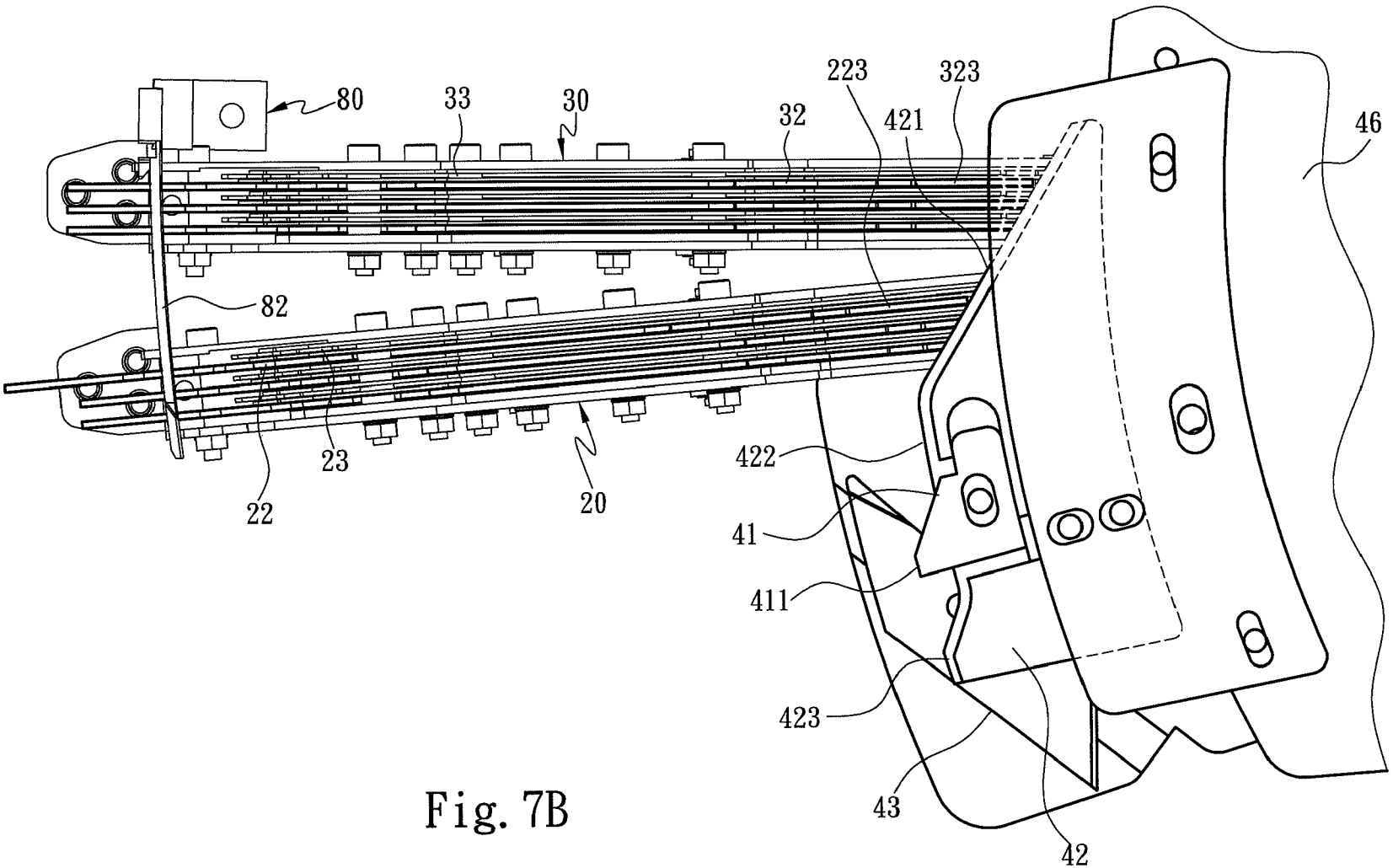

After the first and second yarn changing apparatus 20 and 30 have been driven by the reset cam 44 and selector 45, the remained first and second trigger cranks 24 and 34 at the action position has the first and second forward bosses 223 and 323 exposed and extended outside the second yarn changing apparatus 30 to be driven by the first and second forward cams 41 and 42 later. Referring to FIG. 6A, the first forward cam 41 and second forward cam 42 do not hit the first and second forward bosses 223 and 323 of the first and second yarn feeding means 21 and 31. The first and second yarn feeding plates 22 and 32 are retracted inside the first and second yarn changing apparatus 20 and 30 without moving as shown in FIG. 7A. When the driving cam set 40 gradually moves closer to the first and second yarn feeding means 21 and 31, first, the first yarn feeding means 21 is in contact with the guiding zone 421 of the second forward cam 42 as shown in FIG. 6B; the tail end 222 of the first yarn feeding plate 22 enters the first driving track, and the first forward boss 223 is pushed by the guiding zone 421 so that the first yarn feeding plate 22 and the first yarn clipping plate 23 proceed the first yarn feeding stroke; then the first and second forward cams 41 and 42 continuously move towards the second yarn changing apparatus 30; the second forward boss 323 at the tail end 322 of the second yarn feeding plate 32 also is pushed by the guiding zone 421 so that the second yarn feeding plate 32 and the second yarn clipping plate 33 proceed the second yarn feeding stroke; meanwhile, the first and second yarn feeding means 21 and 31 do not arrive the yarn feeding position and cannot supply the yarns 51 and 52 to the knitting needles 70 as shown in FIG. 7B.

Figure 6C:
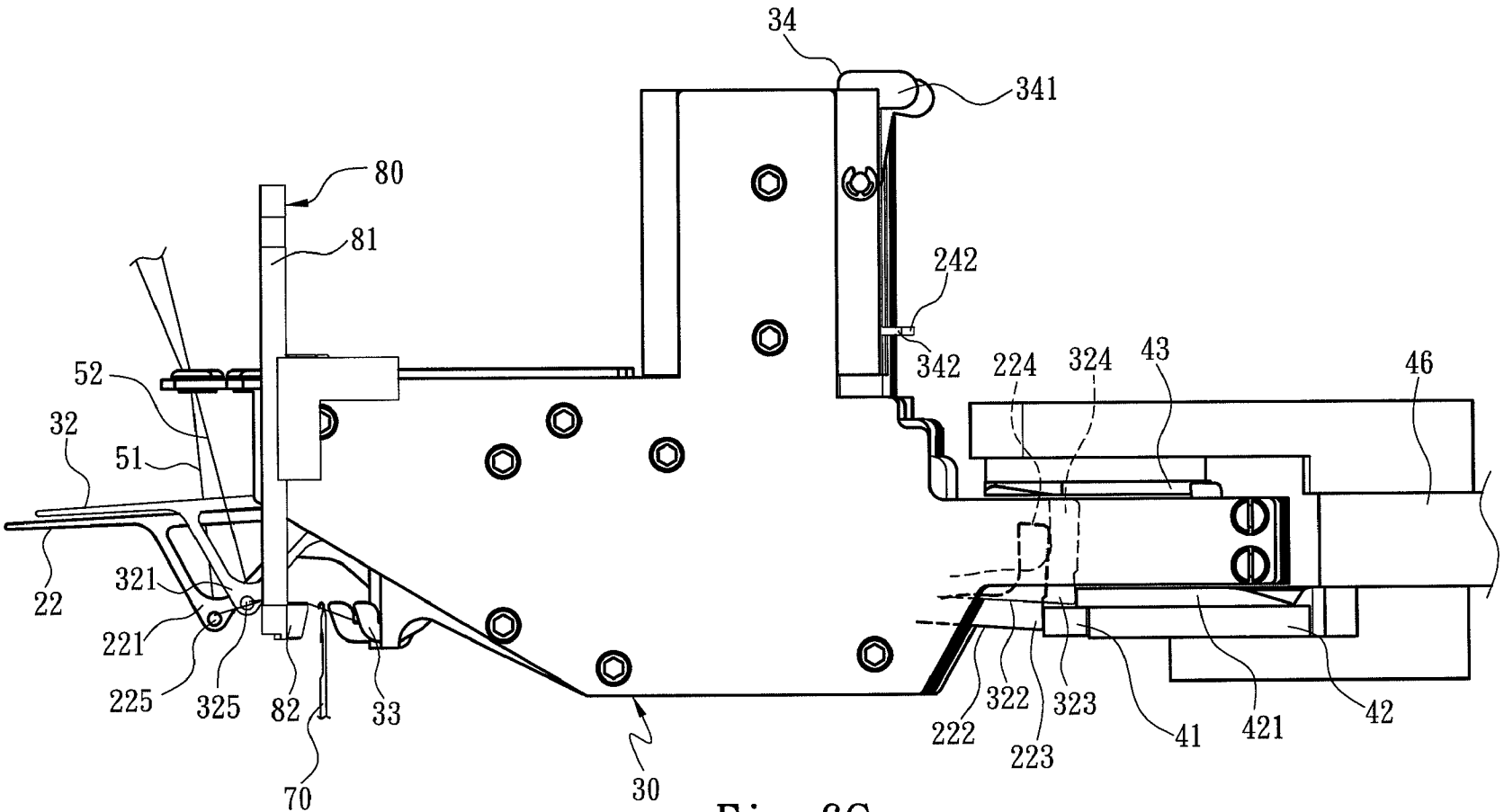
Figure 7C:
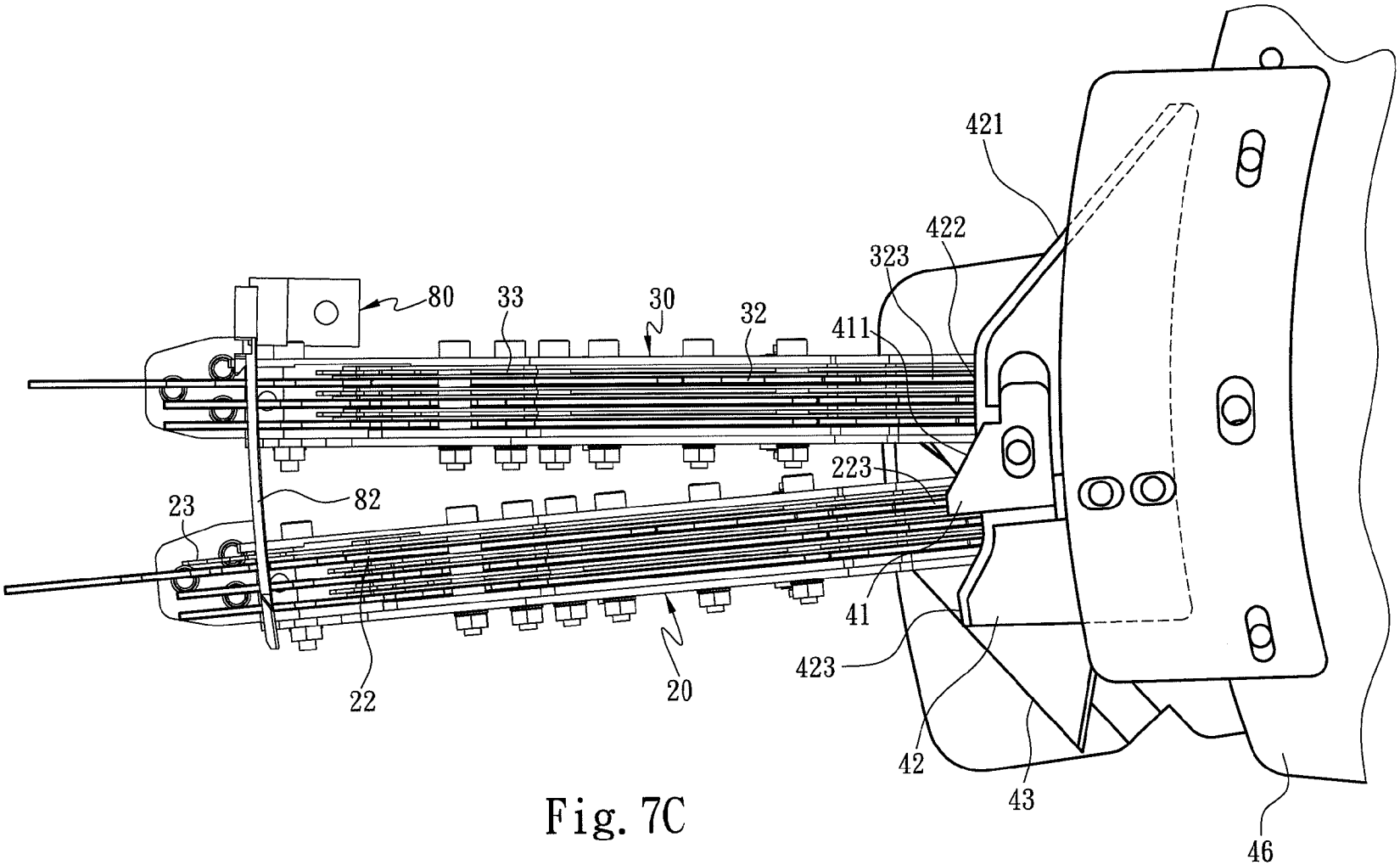

Since the first forward boss 223 of the first yarn feeding plate 22 has a lower bottom edge, when the tail end 222 of the first yarn feeding plate 22 moves along the first driving track to finish movement of the guiding zone 421 and enters the first yarn release zone 411 at a lower position to be driven thereof as shown in FIG. 6C. Hence when the first yarn feeding means 21 finishes the first yarn feeding stroke the head end 221 of the first yarn feeding plate 22 moves across the yarn supply portion 82 of the yarn supply means 80 and arrives the yarn feeding position, and the first yarn clipping plate 23 releases the yarn 51 to be hooked by the knitting needles 70 at the yarn hooking position as shown in FIG. 7C. On the other hand, the second forward boss 323 of the second yarn feeding plate 32 has a higher bottom edge without hitting the first yarn release zone 411 at the lower position, and enters the driving delay zone 422 of the second forward cam 42; meanwhile the second yarn feeding plate 32 still does not finish the first yarn feeding stroke and cannot provide the yarn 52 to the knitting needles 70 at the yarn hooking position.

Figure 6D:
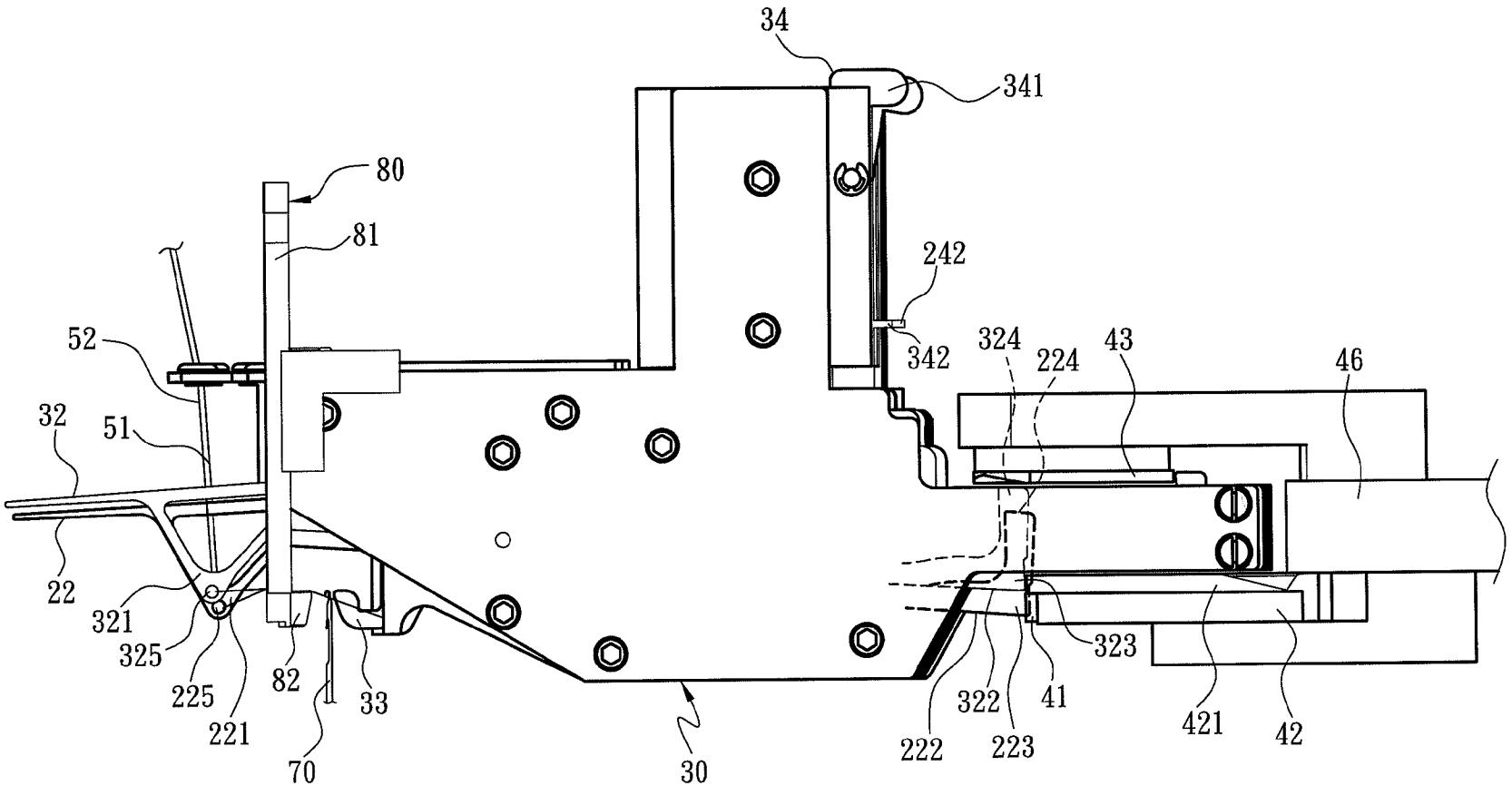
Figure 7D:
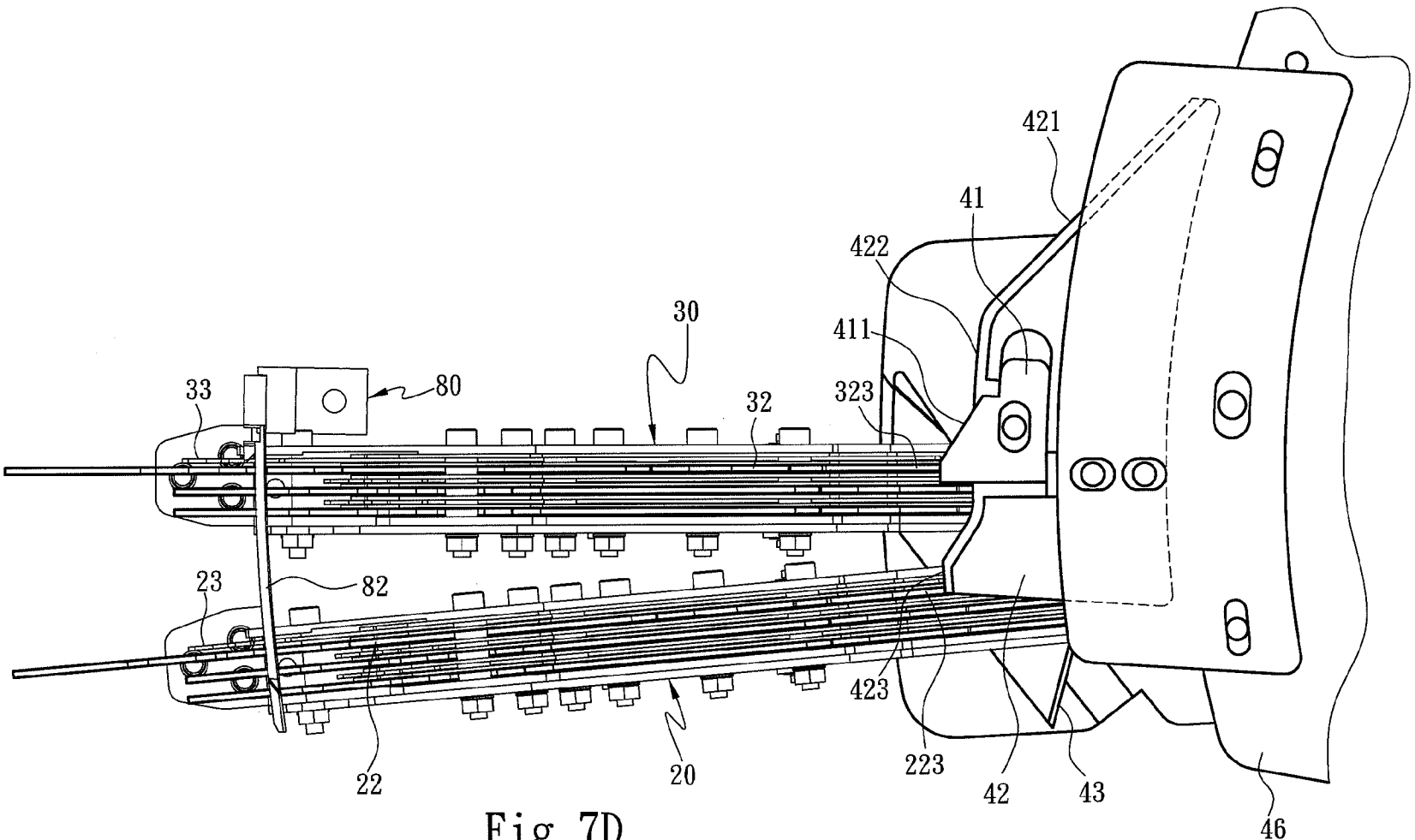

After the second forward boss 323 of the second yarn feeding plate 32 has finished the driving delay zone 422, it is driven by the second yarn release zone 423 as shown in FIG. 6D. When the second yarn feeding means 31 driven by the second yarn release zone 423 has finished the second yarn feeding stroke, the head end 321 of the second yarn feeding plate 32 also moves across the yarn supply portion 82 to the yarn feeding position, and the second yarn clipping plate 33 releases the yarn 52 to be hooked by the knitting needles 70 at the yarn hooking position as shown in FIG. 7D. Meanwhile, the first and second yarn feeding means 21 and 31 can provide the yarns 51 and 52 to the knitting needles 70. Thus in a single knitting process the number of yarns of other colors or types can be increased to be knitted into the fabric.

Figure 8A:
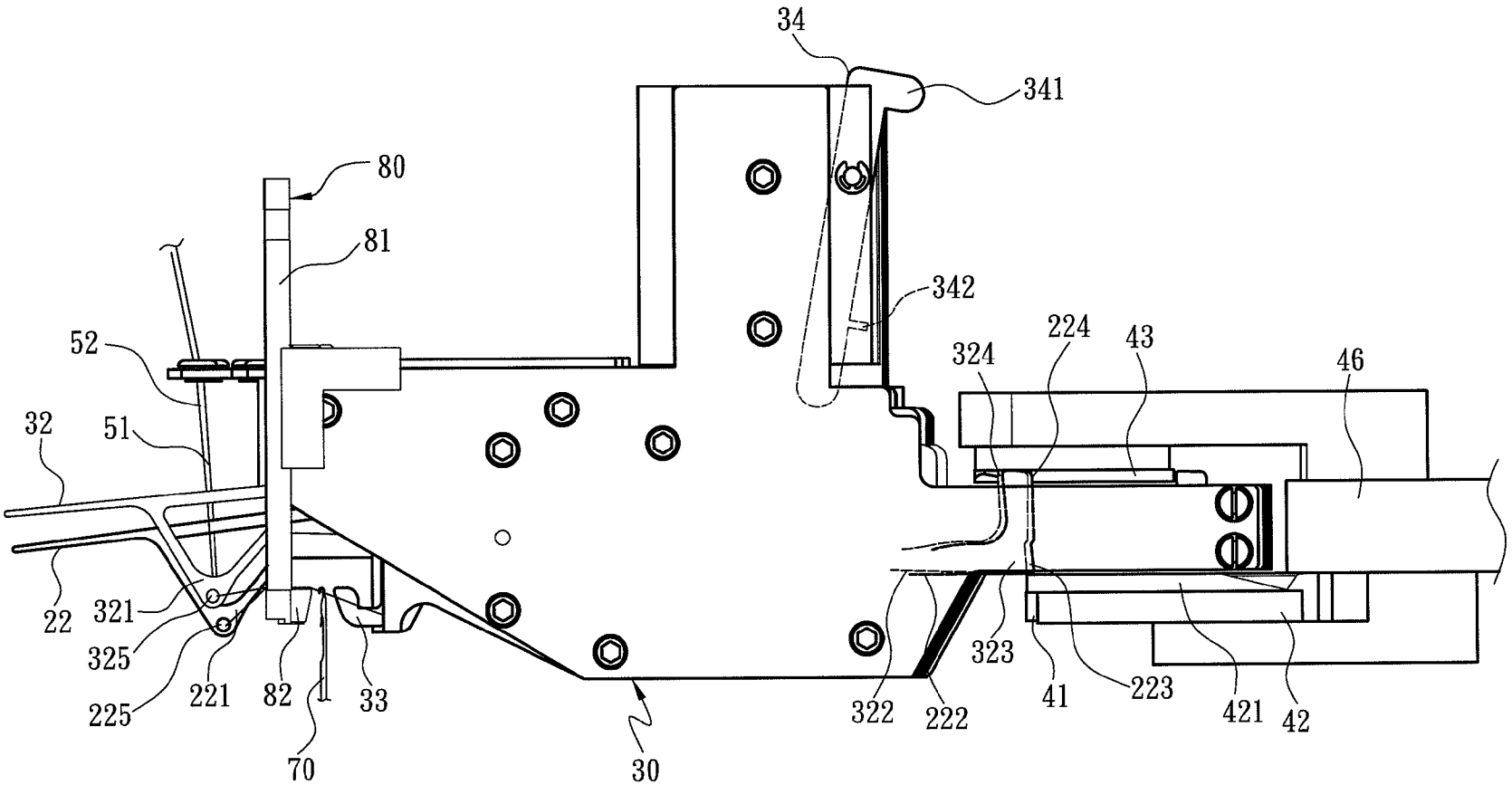
FIGS. 8A through 8D are schematic views of an embodiment of the present invention showing continuous operating conditions of the return cam driving the first and second yarn feeding means back to the first and second yarn changing apparatus.
Figure 8B:
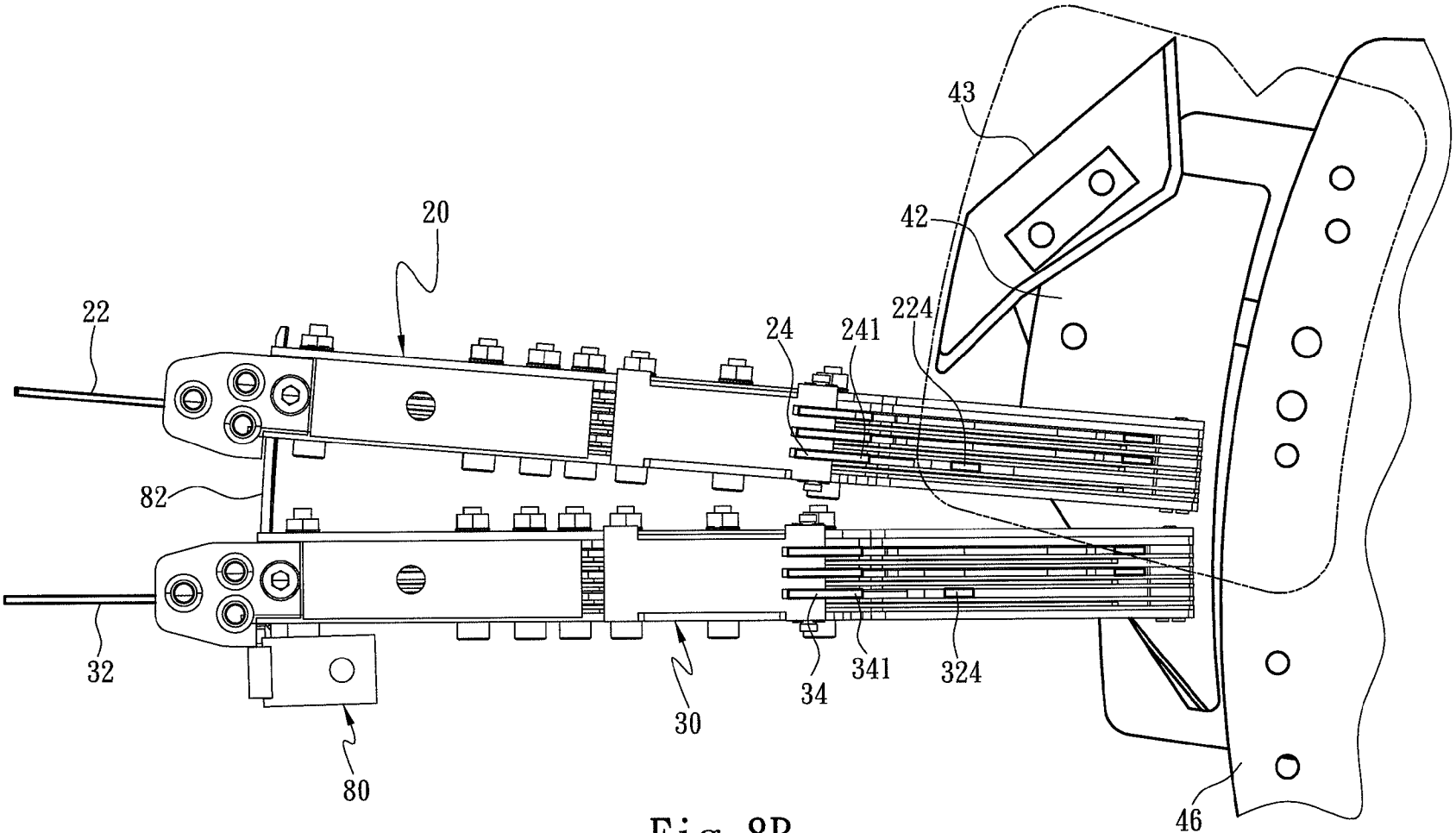
Figure 8C:
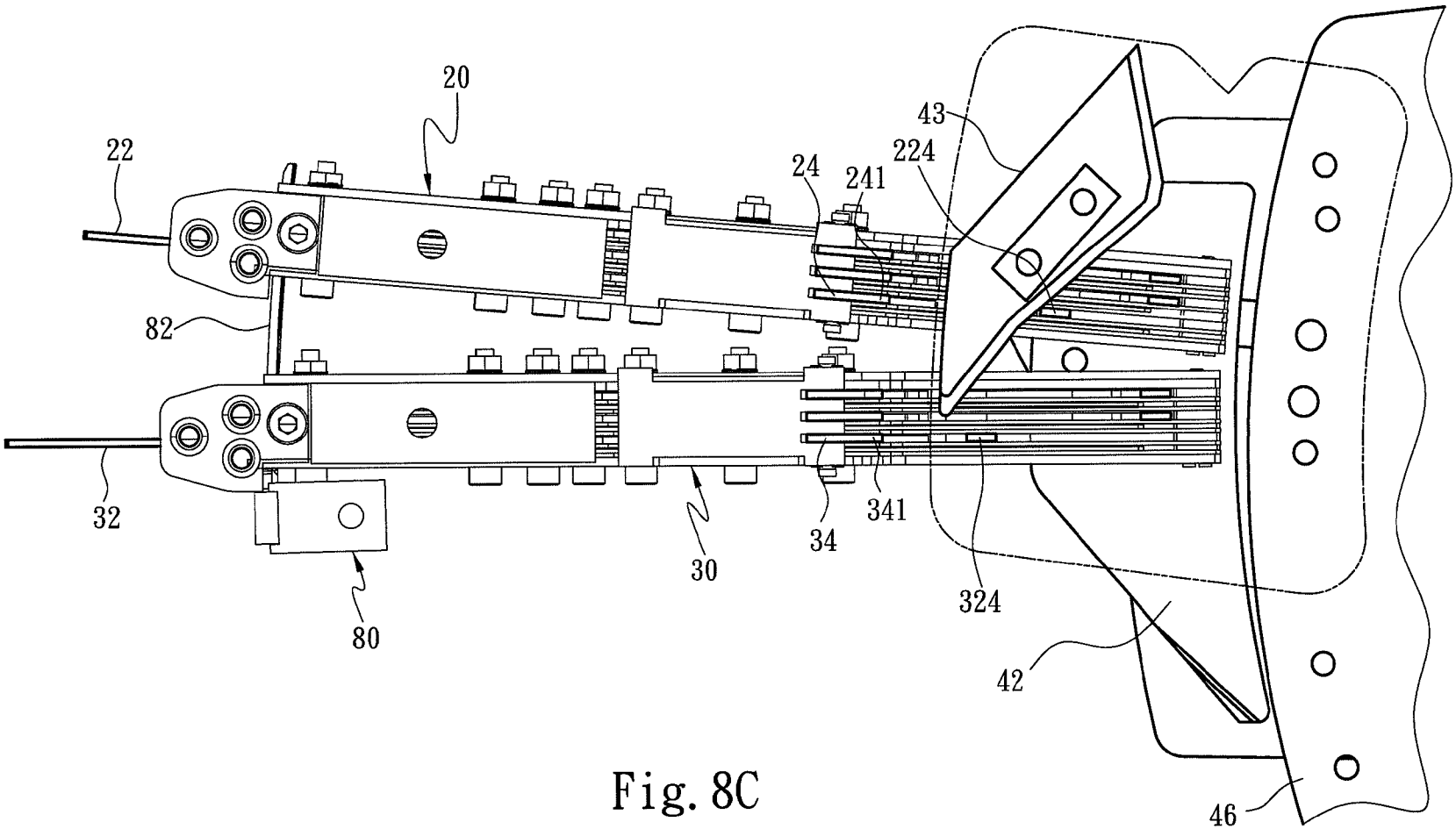
Figure 8D:
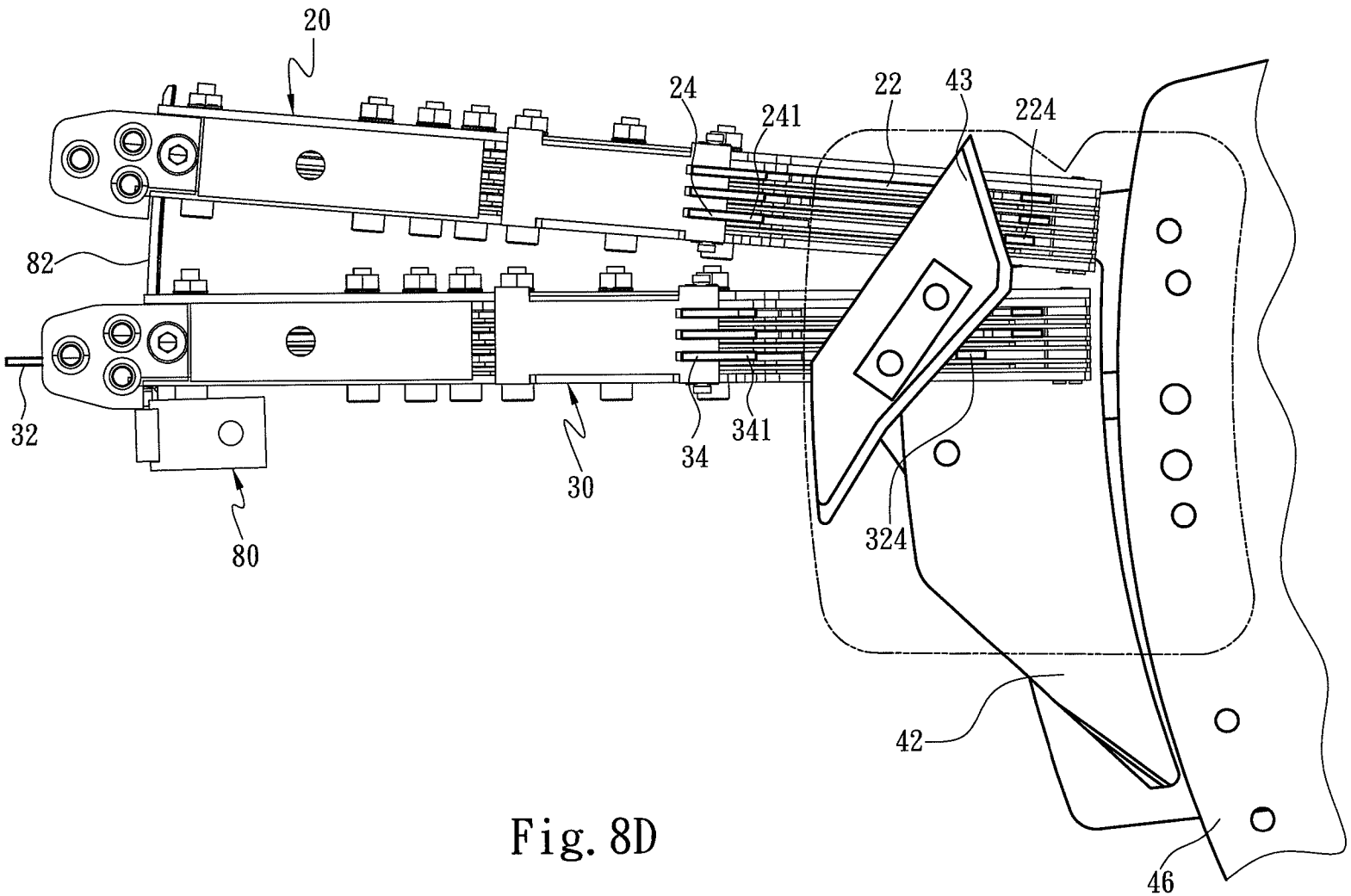

Finally, in the event that to stop supply the yarns 51 and 52 is desired, the first and second trigger cranks 24 and 25 at the action position can be driven again by the reset cam 44 and selector 45 to the closed position. Then the first and second forward bosses 223 and 323 of the first and second yarn feeding plates 22 and 23 are retracted inside the first and second yarn changing apparatus 20 and 30. The first and second return bosses 224 and 324 are extended outside the first and second yarn changing apparatus 20 and 30 as shown in FIG. 8A. The exposed first and second return bosses 224 and 324 are driven by the return cam 43 to move rearwards as shown in FIGS. 8B through 8D. The first yarn feeding means 21 and second yarn feeding means 31 are retracted from the original yarn feeding position for supplying the yarns 51 and 52 inside the first and second yarn changing apparatus 20 and 30, and the first and second yarn clipping plates 23 and 33 are driven by the first and second yarn feeding plates 22 and 32 to sever and clip the yarns 51 and 52.

In the present invention the first and second forward bosses 223 and 323 of the first and second yarn feeding means 21 and 31 are driven by the first and second driving tracks. The second driving track has the extra driving delay zone 422 not existed on the first driving track, hence the first and second yarn feeding means 21 and 31 arrive the yarn feeding position at different times, namely there is a yarn feeding time lag between the second yarn feeding means 31 and first yarn feeding means 21 when they proceed the second yarn feeding stroke and the first yarn feeding stroke.

As a conclusion, the present invention provides a circular knitting machine having integrated multiple yarn changing apparatus. The first yarn feeding means and second yarn feeding means of the first yarn changing apparatus and second yarn changing apparatus are moved to the yarn feeding position at different times to generate a yarn feeding time lag. Through the yarn feeding time lag the yarns of the first and second yarn feeding means are hooked respectively by the knitting needles at the yarn hooking position, thus multiple types of yarns can be included in a single knitting process.

In summation of the above description, the present invention provides a significant improvement over the conventional techniques and complies with the patent application requirements, and is submitted for review and granting of the commensurate patent rights.

While the invention has been described by means of specific embodiments, numerous modifications and variations could be made thereto by those skilled in the art without departing from the scope and spirit of the invention set forth in the claims.

What is claimed is:

1. A circular knitting machine having integrated multiple yarn changing apparatus, comprising:

a first yarn changing apparatus and a second yarn changing apparatus that include respectively at least one first yarn feeding means and at least one second yarn feeding means, the first and second yarn feeding means being moved respectively outwards through a first yarn feeding stroke and a second yarn feeding stroke to a yarn feeding position to provide yarns;

a driving cam set which includes a first driving track and a second driving track that drive respectively the first and second yarn feeding means to proceed respectively the first and second yarn feeding strokes, the second driving track further including a driving delay zone to generate a yarn feeding time lag between the second yarn feeding means while proceeding the second yarn feeding stroke and the first yarn feeding means while proceeding the first yarn feeding stroke; and at least one cylinder holder which holds a plurality of knitting needles, at least the knitting needles located at the yarn feeding position between the first and second yarn feeding means being movable to a yarn hooking position to hook the yarns provided by the first and second yarn feeding means at the yarn feeding time lag.

2. The circular knitting machine of claim 1, wherein the first driving track includes a guiding zone and a first yarn release zone, the second driving track including the guiding zone, the driving delay zone and a second yarn release zone.

3. The circular knitting machine of claim 2, wherein the first yarn release zone of the first driving track is located at a horizontal level different from that of the driving delay zone and the second yarn release zone of the second driving track.

4. The circular knitting machine of claim 1, wherein the first yarn feeding means and the second yarn feeding means include respectively a first forward boss and a second forward boss that are driven respectively by the first driving track and the second driving track.

5. The circular knitting machine of claim 4, wherein the first forward boss at the first yarn feeding stroke is located at a horizontal level different from that of the second forward boss at the second yarn feeding stroke.

6. The circular knitting machine of claim 1, wherein the driving cam set includes a return cam, and the first yarn feeding means and the second yarn feeding means includes respectively a first return boss and a second return boss that are driven by the return cam.

7. The circular knitting machine of claim 1, wherein the needle cylinder holder includes a first cam and a second cam corresponding to the first yarn changing apparatus and the second yarn changing apparatus to guide movement of the knitting needles, the first cam and the second cam forming a continuous yarn hooking track to keep the knitting needles at the yarn hooking position to hook the yarns provided by the first and second yarn feeding means.

8. The circular knitting machine of claim 1, wherein the first and second yarn changing apparatus include a yarn supply means at one side thereof, the yarn supply means including a fastening portion and a yarn supply portion, the yarn supply portion being extended at least to the knitting needles located between the yarn feeding position of the first and second yarn feeding means.

* * * * *